US007185518B1

(12) United States Patent
Huang

(10) Patent No.: US 7,185,518 B1
(45) Date of Patent: Mar. 6, 2007

(54) SAFETY LOCK FOR COMPUTER

(75) Inventor: Joseph Huang, Taoyuan (TW)

(73) Assignee: Ho E Screw & Hardware Co., Ltd., Taoyuan (TW)

( * ) Notice: Subject to any disclaimer, the term of this patent is extended or adjusted under 35 U.S.C. 154(b) by 0 days.

(21) Appl. No.: 11/245,216

(22) Filed: Oct. 7, 2005

(51) Int. Cl.
*E05B 73/00* (2006.01)

(52) U.S. Cl. ..... 70/14; 70/58

(58) Field of Classification Search ..... 70/58, 70/57, 14, 424, 426, 428, 491, 30
See application file for complete search history.

(56) References Cited

U.S. PATENT DOCUMENTS 3,136,017 A * 6/1964 Preziosi ..... 411/552
5,327,752 A * 7/1994 Myers et al. ..... 70/58
5,381,685 A * 1/1995 Carl et al. ..... 70/58
6,463,770 B1 * 10/2002 Lee ..... 70/58
6,619,081 B1 * 9/2003 Yu ..... 70/58
6,973,809 B2 * 12/2005 Chang ..... 70/58

* cited by examiner

*Primary Examiner*—Lloyd A. Gall

(57) ABSTRACT

A safety lock with a switching unit for a computer, it has a lock set in its housing being connected to a locking cable through a manifold unit, a switching unit adapted to moving to a first or a second position, and a lock head for locking a lock hole of the computer. The switching unit has a switching lever extending out of the housing; the switching lever can be moved to a first or a second position when the lock set is in an unlocking state to control the lock head to be in a locking position or an unlocking position relative to the lock hole of the computer.

5 Claims, 8 Drawing Sheets

SAFETY LOCK FOR COMPUTER

BACKGROUND OF THE INVENTION

1. Field of the Invention

The present invention is related to a safety lock with a switching unit for a computer, and especially to a safety lock for a computer of which the switching unit is provided in the safety lock to control operation of a lock head.

2. Description of the Prior Art

In a prior patent case, namely the U.S. Pat. No. 3,136,017 titled (fastening device), a lock head with a T shaped rotating axle is provided, and a fixing seat is provided allowing extending through of a T shaped rotating shank, a protruding seat is provided in front of the fixing seat for engaging in a rectangular lock hole provided on a wall of an article to be locked; and by rotating of the T shaped rotating axle, when a transverse head on the tailing end of the T shaped rotating axle is aligned with and parallel to the protruding seat, an unlocking position is formed, while a locking position is formed if they perpendicularly cross over each other.

Moreover, in prior patent cases including a U.S. Pat. No. 5, 381,685 titled (computer physical security device) and a U.S. Pat. No. 5,327,752 titled (computer equipment lock), the above stated lock head structure is used to provide safety locking devices for computers having rectangular lock holes in order to prevent the computers from stealing.

In the prior patent cases concerning safety locks for computers, by virtue that a transverse head on the tailing end of a T shaped rotating axle is extended into a wall of a computer having a lock hole, and is not visible for an operator who can not thereby assure whether the lock head is at a locking position or an unlocking position; thereby it is very hard to make sure whether the lock head can be drawn out from the lock hole of the computer. If the lock head is forcedly drawn out in a locking state, the lock hole may be destroyed to damage the commodity computer; contrarily, if the lock hole is deemed as being locked when it is in an unlocking position, stealing will not at all be prevented. And these are the main defects of the conventional techniques.

SUMMARY OF THE INVENTION

In view of the above stated disadvantages of the conventional techniques, the safety lock structure for a computer of the present invention is devised to have a switching unit which has a switching lever extending out of a housing; the switching lever can be moved to a first or a second position when the lock set is in an unlocking state to control a lock head to be in a locking position or an unlocking position; thereby, an operator can observe the position of the switching lever to assure the state of the lock head in a lock hole of the computer to reduce misjudging.

The main object of the safety lock with a switching unit for a computer provided by the present invention is to make operation of the safety lock easier and more effective by taking advantage of the operating of the switching unit to control the position of the lock head.

The present invention will be apparent in the feature of its structure and the effects of operation after reading the detailed description of the preferred embodiments thereof in reference to the accompanying drawings.

DETAILED DESCRIPTION OF THE PREFERRED EMBODIMENT

Figure 1:
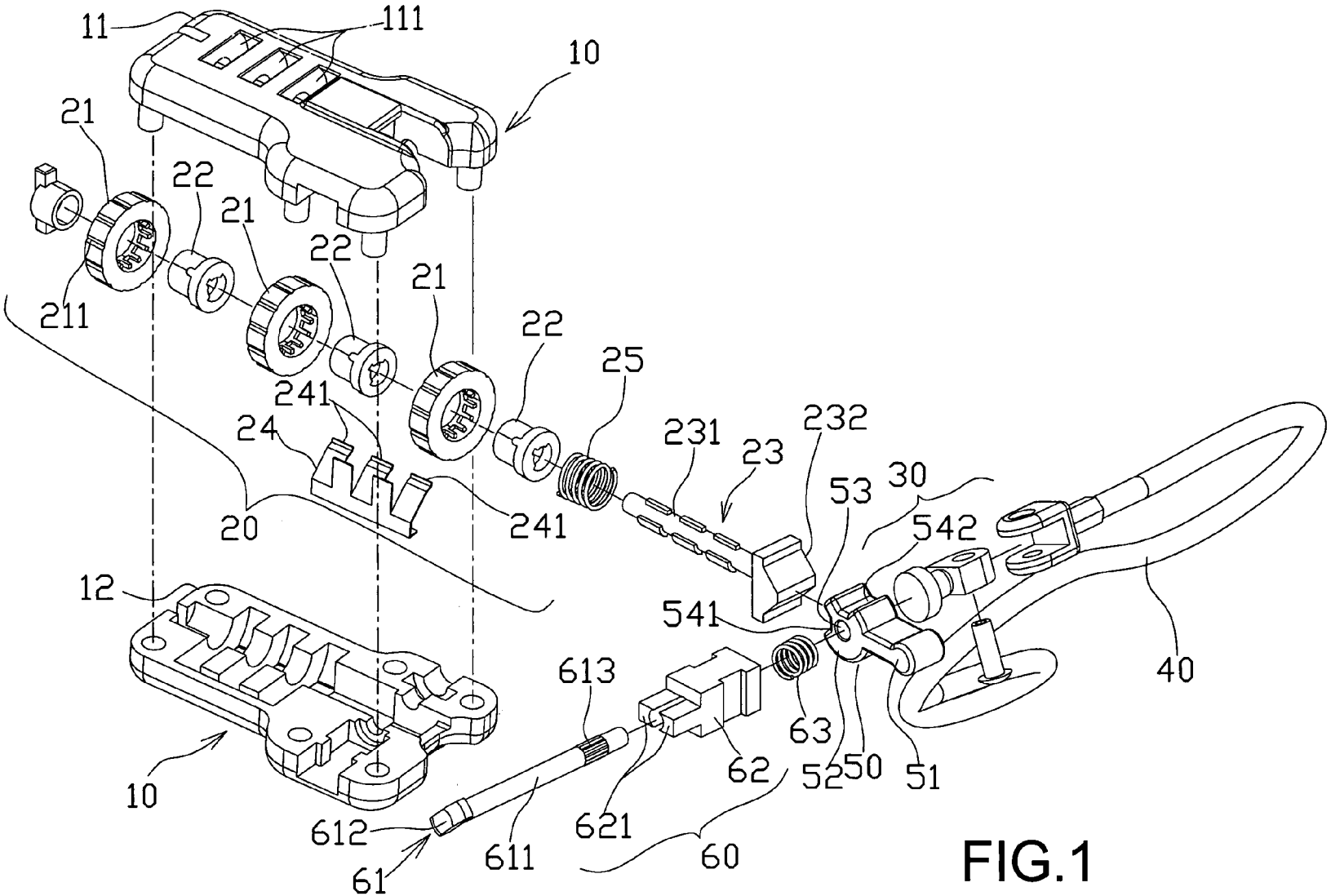
FIG. 1 is an anatomic perspective view of an embodiment of the present invention.
Figure 2:
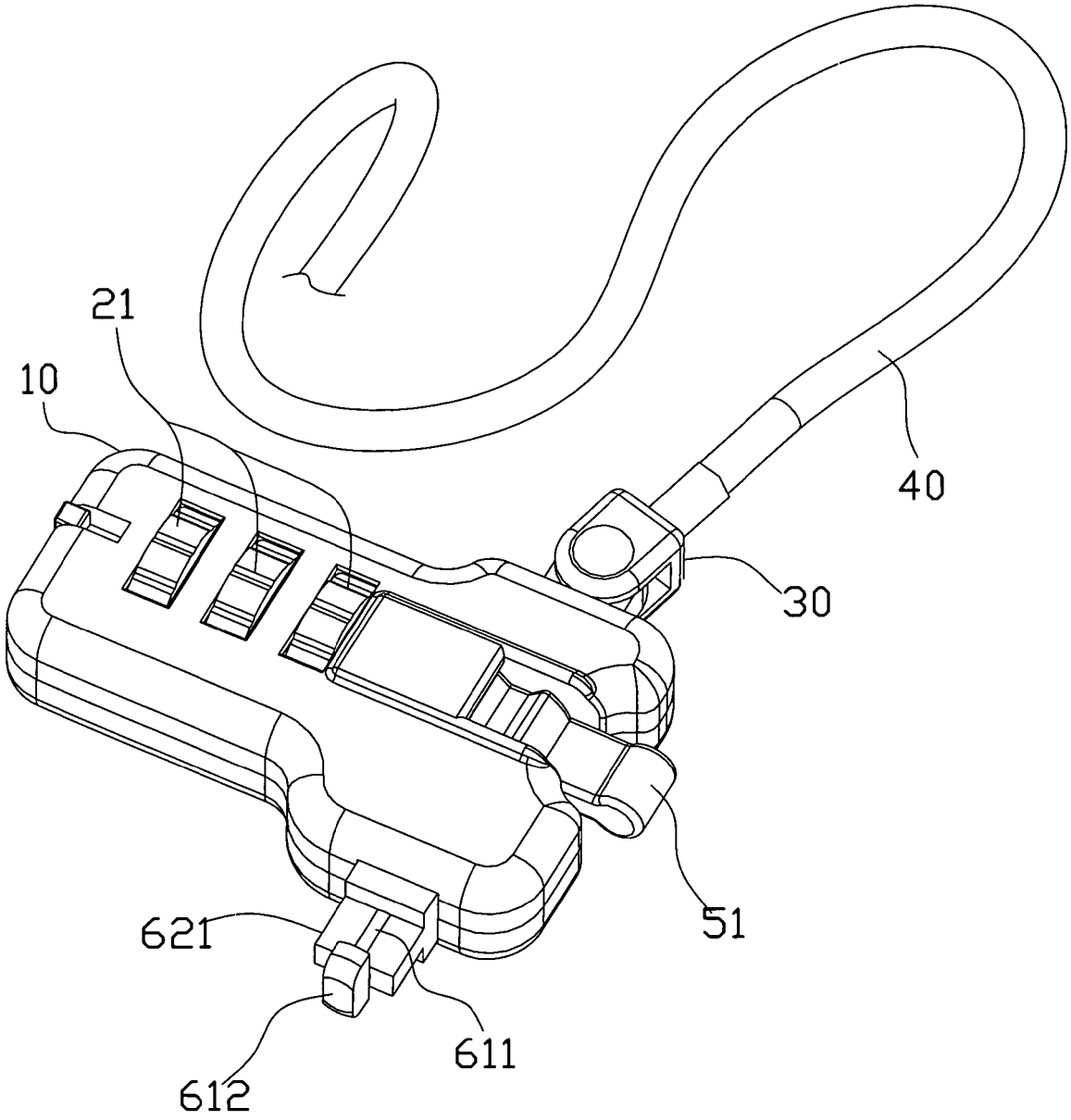
FIG. 2 is a perspective view after assembling of the embodiment of FIG. 1.
Figure 3:
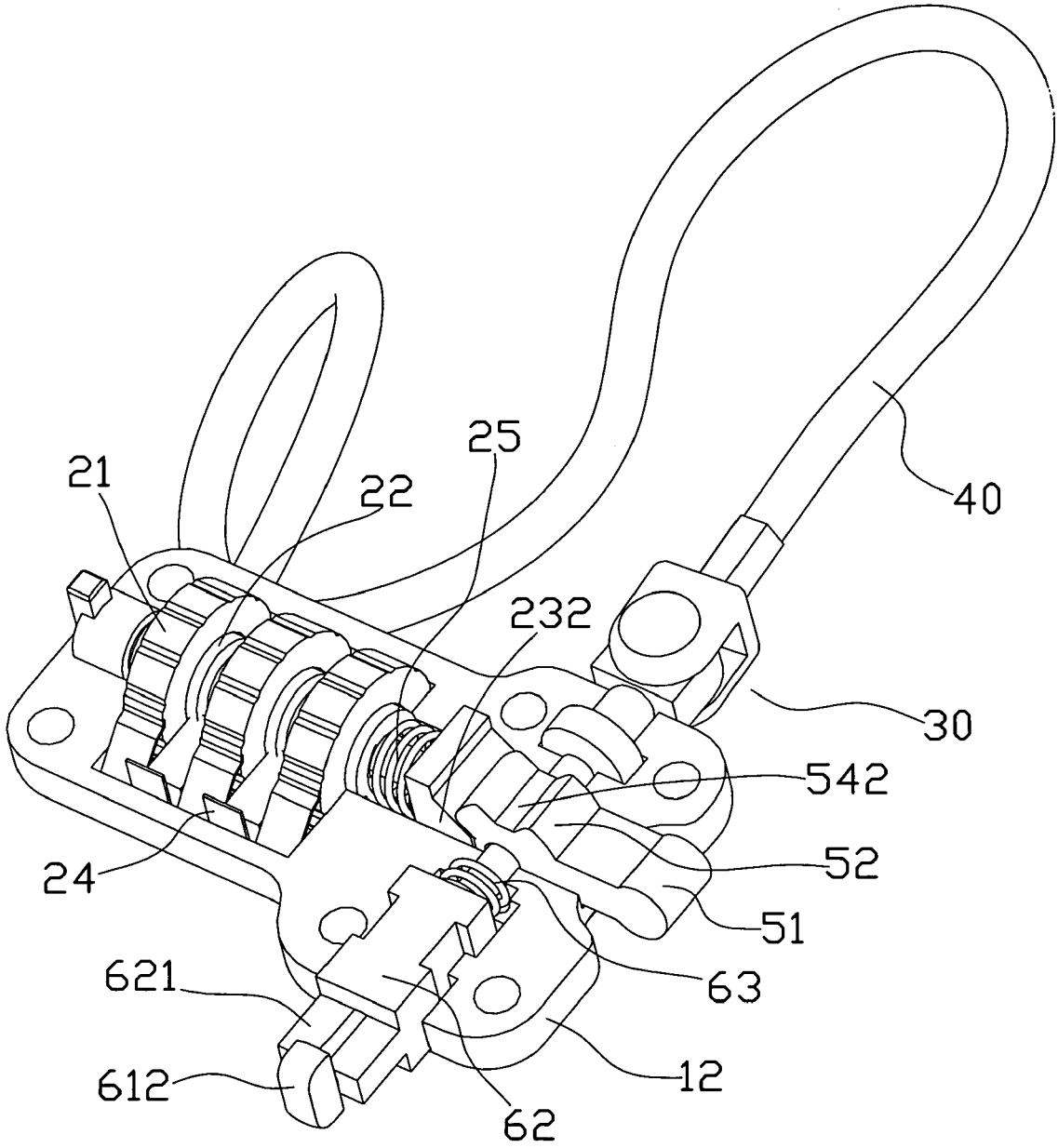
FIG. 3 is a perspective view after assembling as that of FIG. 2 with an upper housing part removed.

Referring to FIGS. 1 to 3, the safety lock with a switching unit for a computer of the present invention mainly has a housing 10 openable by pulling one part of it upwards or downwards against the other part, the housing 10 is composed of an upper housing part 11 and a lower housing part 12. The housing 10 is connected to a locking cable 40 through a manifold unit 30. The housing 10 accommodates therein a lock set 20, a switching unit 50 and a set of lock head 60.

The lock set 20 has an unlocking position and a locking position, the structure depicted in the drawings is a number lock (the present invention is not limited to this), and has a plurality of number wheels 21 and a plurality of lock wheels 22 mutually in equal number, they are sequentially provided on an axle shaft 231 of a lock axle 23; spring leaves 241 provided on a spring set 24 abut cut recesses 211 provided on the number wheels 21 for moving the number wheels 21 number by number, thereby numbers shown in display holes 111 in the upper housing part 11 can be changed; a spring 25 is provided on the axle shaft 231 of the lock axle 23 to keep a locking block 232 on the tailing end of the lock axle 23 to be pushed rightwards. When all the number wheels 21 show correct numbers, the lock set 20 is in an unlocking position, then the lock axle 23 can be moved axially upwards, by switching (pulling or pushing) of the switching unit 50 for the locking block 232 on the tailing end of the lock axle 23, unlocking and locking of the lock head 60 can be controlled. In view that the number lock is a known mechanism and is not a main device of the present invention, no further narration for it is required.

The lock head 60 has, as are the cases of the prior patents, a fixing seat 62 and a T shaped rotating axle 61. Wherein the fixing seat 62 is extended through by a rotating shank 611 of the T shaped rotating axle 61, a front protruding seat 621 protrudes out of the housing 10 and is extended into a lock hole of the computer; a spring 63 is provided on the tailing end of the fixing seat 62 to keep the protruding seat 621 of the fixing seat 62 to be pushed forwards. If a transverse head 612 on the front end of the T shaped rotating axle 61 is aligned with and parallel to the protruding seat 621, an unlocking position is formed; and the transverse head 612 can be extended into and moved out of the lock hole of the computer; when the transverse head 612 perpendicularly crosses over the protruding seat 621, a locking position is formed, hence the lock hole of the computer can be locked as is the case of a conventional lock head.

The improvement of the present invention is resided in that it is devised to have a switching unit 50 in the safety lock for a computer. The switching unit 50 has a switching lever 51 extending out of the housing 10; the switching lever 51 can be moved to a first or a second position when the lock set 20 is in an unlocking state. The end of the switching lever 51 extending into the housing 10 is connected with a pusher block 52 which has an axle hole 53 for extending therethrough and engaging therewith of a knurled portion 613 on the rotating shank 611 of the T shaped rotating axle 61; thereby when the switching lever 51 is moved, the pusher block 52 will rotate the T shaped rotating axle 61 to changed the relative position of the transverse head 612 on the front end of the T shaped rotating axle 61 to the protruding seat 621.

Figure 5A:
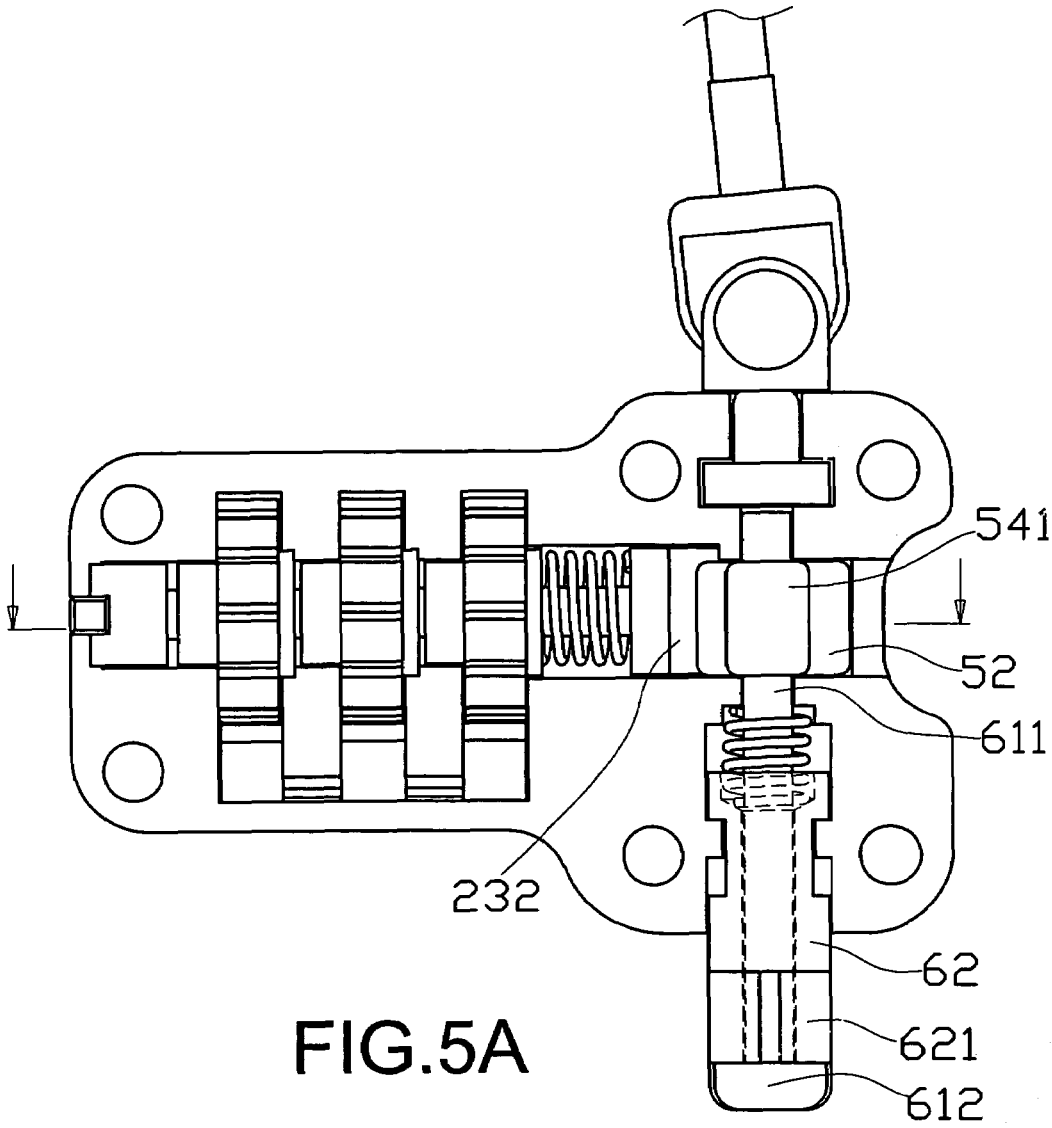
FIG. 5A is a front sectional view of taking from FIG. 5 showing a position when a transverse head is aligned with and parallel to a protruding seat.
Figure 5:
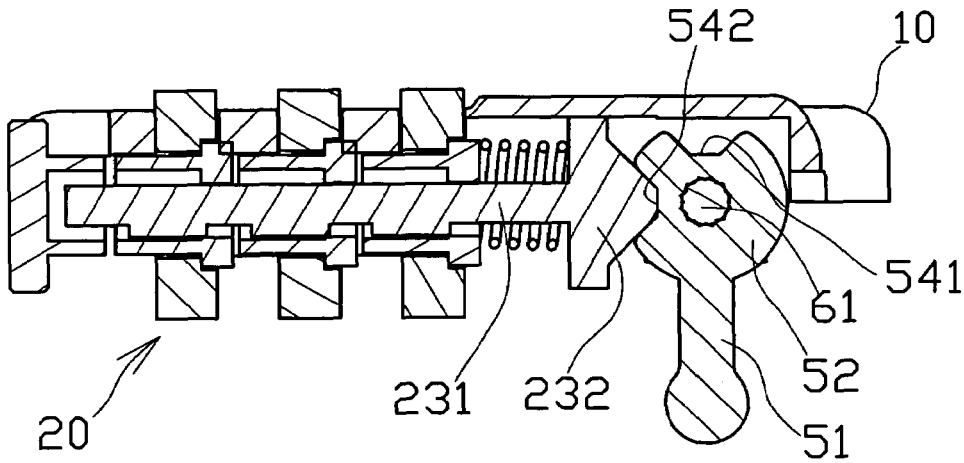
FIG. 5 is a sectional view of the present invention showing a first operating position of a switching lever.
Figure 6A:
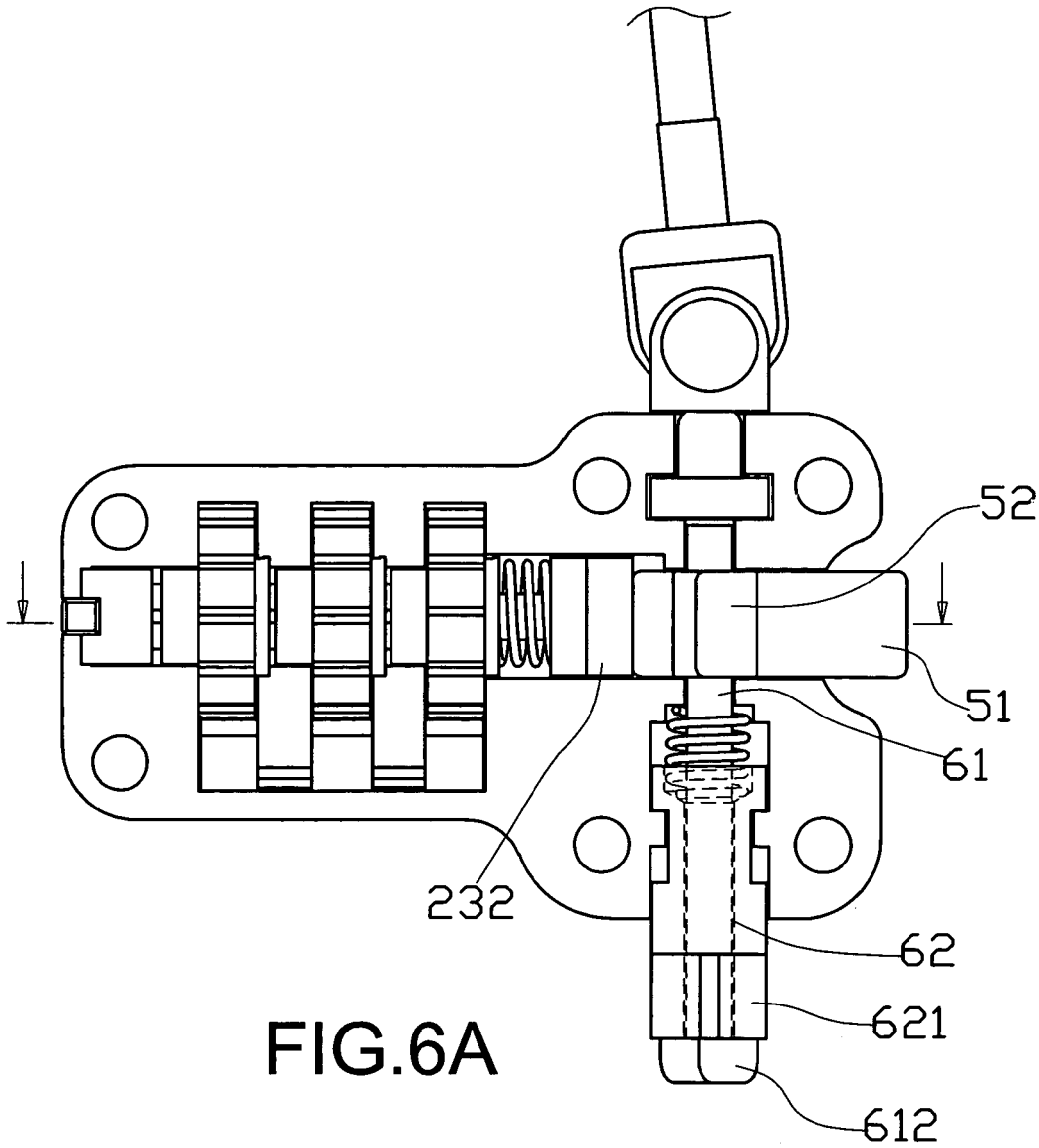
FIG. 6A is a front sectional view of taking from FIG. 6 showing a position when a transverse head is in an inclined position against the protruding seat.
Figure 6:
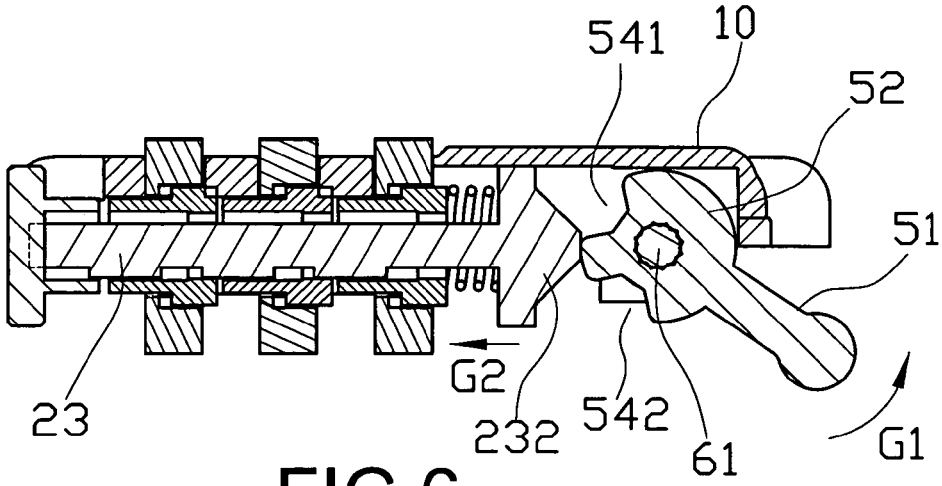
FIG. 6 is a sectional view of the present invention showing a second operating position of the switching lever.
Figure 7A:
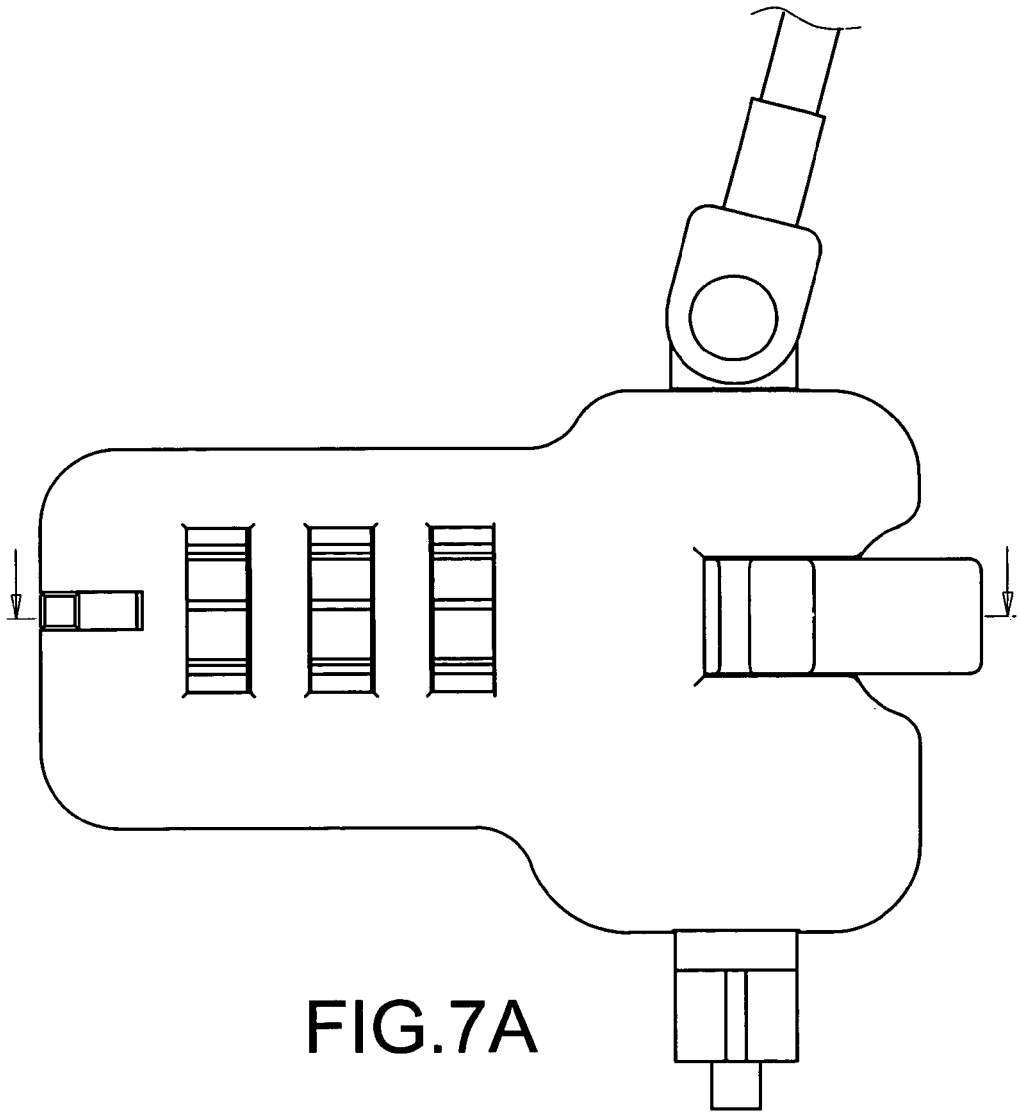
FIG. 7A is a front sectional view of taking from FIG. 7 showing a position when a transverse head is in a perpendicular position to the protruding seat.
Figure 7:
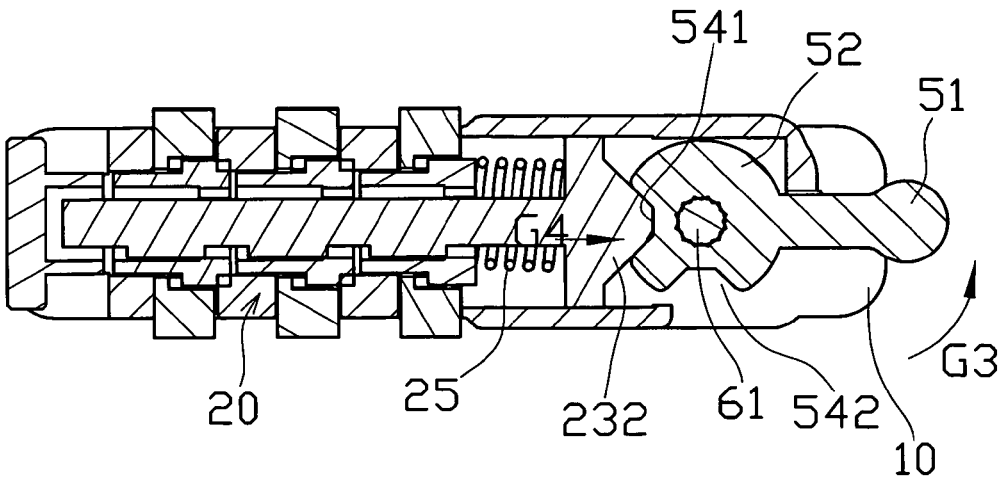
FIG. 7 is a sectional view of the present invention showing a third operating position of the switching lever.

The pusher block 52 is provided thereon with a first recess 541 and a second recess 542, When the two recesses are engaged in by the locking block 232 on the tailing end of the lock axle 23 of the lock set 20, if the lock set 20 is in a locking state, the switching lever 51 is unable to be moved; however, if the lock set 20 is in an unlocking state when the number wheels 21 show correct numbers, the lock axle 23 is movable, and the switching lever 51 can be moved to rotate the pusher block 52 and switched to the other recess of the two recesses 541, 542 as are shown in FIGS. 5–7.

Figure 4:
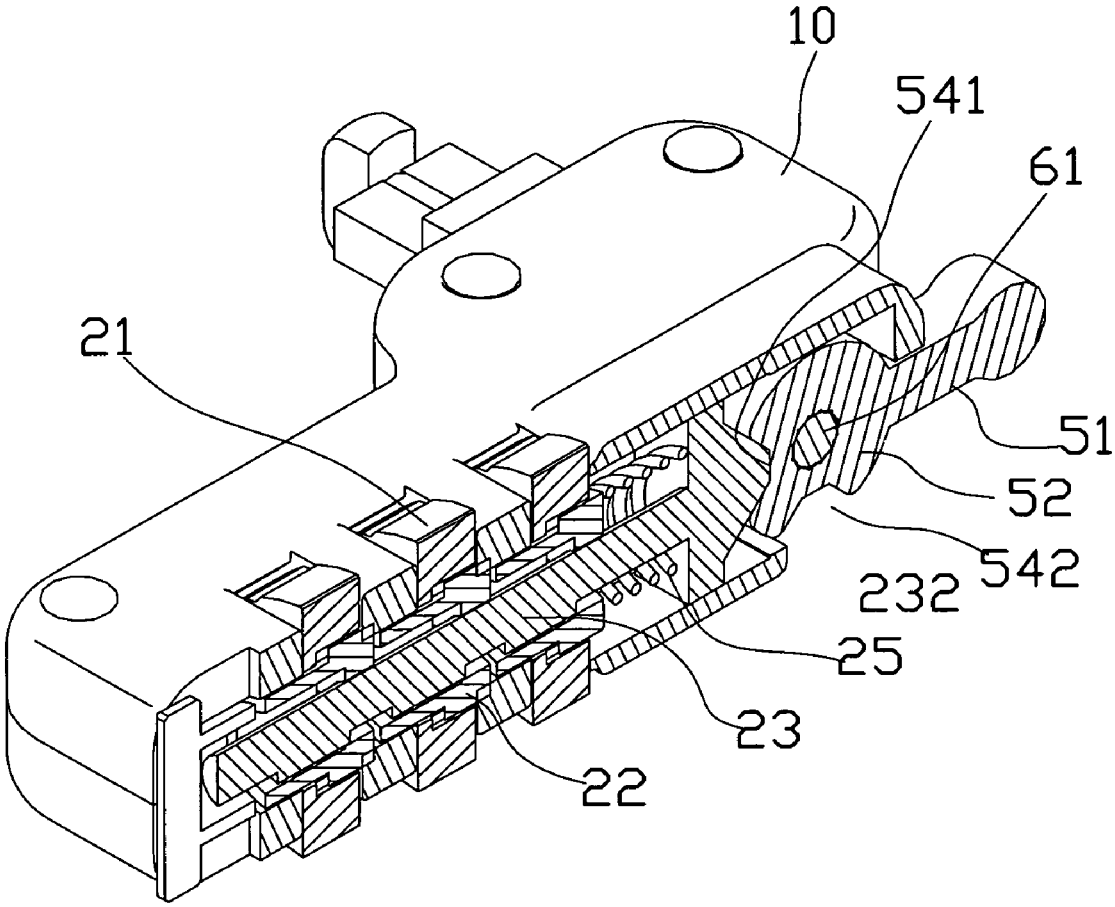
FIG. 4 is a perspective view after assembling as that of FIG. 2 but partially sectioned.

In this embodiment, the locking block 232 on the tailing end of the lock axle 23 includes two inclined surfaces as shown FIG. 4; the connecting area between the two inclined surfaces is a small section of vertical surface, thereby a quasi trapezoidal shape is formed from them; the pusher block 52 basically is cylindrical, it has the first recess 541 at a position diametrically opposite to the switching lever 51, and has the second recess 542 at a position 90 degrees away from the first recess 541. With this structure, when the switching lever 51 is moved, the T shaped rotating axle 61 can be rotated for 90 degrees to make the transverse head 612 on the front end of the T shaped rotating axle 61 aligned with and parallel to or perpendicularly cross over the protruding seat 621, such as are shown in FIGS. 5A–7A.

The followings will describe the operation of the present invention in FIGS. 5–7.

Referring to FIG. 5, in an initial locking state of the lock set 20, the locking block 232 on the tailing end of the lock axle 23 is engaged in the second recess 542 on the pusher block 52 of the switching unit 50, at this time, the switching lever 51 is perpendicular to the housing 10. And referring to FIG. 5A, in the initial locking state, the pusher block 52 is set to make the transverse head 612 on the front end of the T shaped rotating axle 61 aligned with and parallel to the protruding seat 621 of the fixing seat 62, i.e., the lock head 60 is in an unlocking position. If the lock set 20 is in the locking state, the lock axle 23 is unable to move axially upwards, namely, the switching lever 51 can not be moved.

Further please refer to FIG. 6, when the lock set 20 is in the unlocking state and the number wheels 21 show correct numbers, the lock axle 23 can be moved axially (as shown with an arrow G2). If the switching lever 51 is moved, the switching lever 51 is moved from an orientation perpendicular to the housing 10 to an orientation parallel to the housing 10 (as shown with an arrow G1), now the pusher block 52 moves the locking block 232 of the lock axle 23 axially upwards, and the locking block 232 can be released from engaging with the second recess 542. And referring to FIG. 6A, the transverse head 612 on the front end of the T shaped rotating axle 61 is inclined against the protruding seat 621 by rotating of the switching lever 51.

Referring to FIG. 7, when the switching lever 51 keeps on to be moved along the direction of an arrow G3 to be parallel to the housing 10, the locking block 232 on the tailing end of the lock axle 23 is moved toward the direction of an arrow G4 by pushing of the spring 25 and is engaged at this time in the first recess 541 of the switching unit 50. Referring to FIG. 7A, now the transverse head 612 on the front end of the T shaped rotating axle 61 perpendicularly crosses over the protruding seat 621 to form the locking position, and thus the transverse head 612 can lock the lock hole of the computer. If the lock set 20 is rotated to be in the locking state, the number wheels 21 are moved to show incorrect numbers, and the lock axle 23 can not be moved axially upwards, namely, the switching lever 51 can not be moved, and a locking state is formed.

Evidently, the switching unit 50 devised in the present invention will render easier of the operation of discriminating whether the transverse head 612 on the tailing end of the T shaped rotating axle 61 of the lock head 60 is aligned with and parallel to the protruding seat 621 (the unlocking position) or perpendicularly crosses over the protruding seat 621 (the locking position), so that a user can judge how to operate the lock set 20 to reduce errors in operation.

Figure 8:
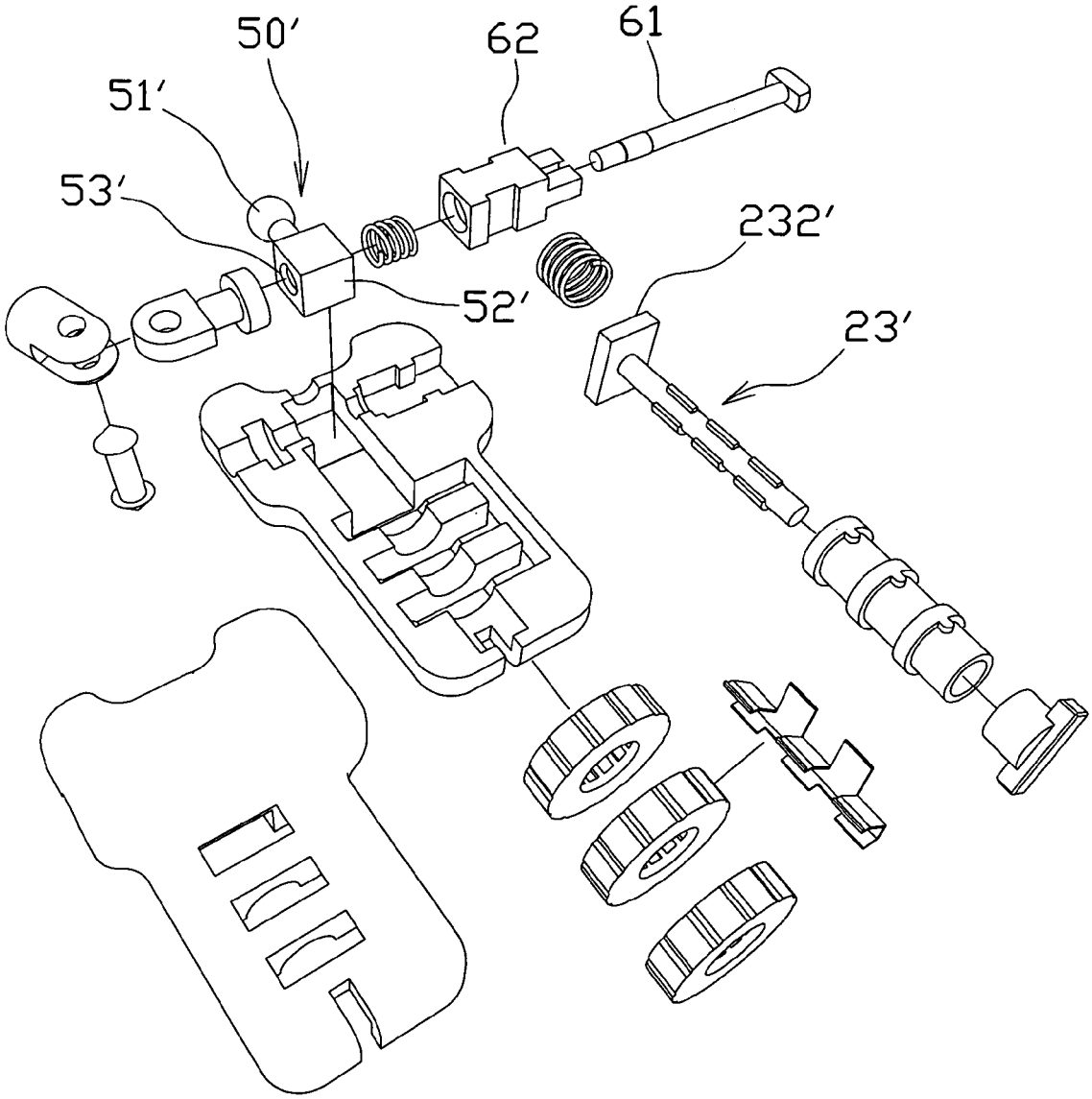
FIG. 8 is an anatomic perspective view of another embodiment of the present invention.

Further, the switching unit 50 can also be devised to be the structure as shown in FIG. 8, wherein a pusher block 52' connected with the tailing end of a switching lever 51' extending into the housing 10 is a square cube, while a locking block 232' on the tailing end of a lock axle 23' of the lock set 20 is a flat plate. And the switching lever 51' can also be moved to control that the transverse head 612 on the tailing end of the T shaped rotating axle 61 is aligned with and parallel to or perpendicularly crosses over the protruding seat 621. And this is the other embodiment of the present invention.

Evidently, the switching unit devised in the present invention is not limited to the embodiments shown. It will be apparent to those skilled in this art that various modifications or changes can be made to the present invention without departing from the technical spirit of this invention. Accordingly, all such modifications and changes also fall within the scope of the appended claims.

The invention claimed is:

1. A safety lock with a switching unit for a computer, said safety lock is adapted for engaging in a rectangular lock hole provided on said computer for locking; said safety lock comprises:

a housing;

a lock set provided in said housing and being in an unlocking state or a locking state;

a locking cable extended out of said housing;

a lock head having an unlocking position to be extended into or drawn out from a lock hole of said computer, and having a locking position for locking said lock hole; and a switching unit which has a switching lever extending out of said housing; when said lock set is in an unlocked state, said switching lever is adapted to moving to a first or a second position, when said switching lever is in said first position, said lock head is always controlled to be in a locking position; and when said switching lever is in said second position, said lock head is always controlled to be in an unlocking position; when said lock set is in said locking state, said switching lever is fixed and unable to be moved, wherein said lock head has a T shaped rotating axle and a fixing seat, said fixing seat is provided in said housing and has a protruding seat protruding out of said housing; a rotating shank of said T shaped rotating axle is extended through said fixing seat from outside of said protruding seat, when a transverse head on a tailing end of said T shaped rotating axle is aligned with and parallel to said protruding seat, an unlocking position is formed, while a locking position is formed if said transverse head perpendicularly crosses over said protruding seat, wherein said lock set at least has a locking block on a tailing end of a lock axle; said lock axle is moved axially upwards when said lock set is in an unlocking position, and is fixed when said lock set is in a locking position, wherein one end of said switching lever extending into said housing is connected with a pusher block which has an axle hole for extending therethrough and engaging therewith of said rotating shank of said T shaped rotating axle; thereby when said switching lever is moved, said pusher block rotates said T shaped rotating axle to change the relative position of said transverse head on a front end of said T shaped rotating axle to that of said protruding seat, wherein said pusher block of said switching unit is provided thereon with a first and a second recess for engaging therein of said tailing end of said lock axle of said lock set, wherein one of the first and the second recess corresponds to the locked position and another of the first and the second recess corresponds to the unlocked position.

2. The safety lock with a switching unit for a computer as claimed in claim 1, wherein said lock set is a number lock, when said number lock shows correct numbers, said lock set is in an unlocking position, and said switching lever is adapted to being moved.

3. The safety lock with a switching unit for a computer as claimed in claim 1, wherein said locking block on said tailing end of said lock axle includes two inclined surfaces; a connecting area between said two inclined surfaces is a small section of vertical surface.

4. The safety lock with a switching unit for a computer as claimed in claim 1, wherein said locking cable is connected to said housing through a manifold unit.

5. The safety lock with a switching unit for a computer as claimed in claim 1, wherein said pusher block of said switching lever is a square cube, while said locking block on said tailing end of said lock axle of said lock set is a flat plate.

* * * * *